US008104436B2

(12) United States Patent
Gray, Jr.

(10) Patent No.: US 8,104,436 B2
(45) Date of Patent: Jan. 31, 2012

(54) QUASI FREE PISTON ENGINE

(75) Inventor: Charles L. Gray, Jr., Pinckney, MI (US)

(73) Assignee: The United States of America as represented by the Administrator of the Environmental Protection Agency, Washington, DC (US)

( * ) Notice: Subject to any disclaimer, the term of this patent is extended or adjusted under 35 U.S.C. 154(b) by 412 days.

(21) Appl. No.: 12/387,369

(22) Filed: May 1, 2009

(65) Prior Publication Data

US 2010/0275884 A1 Nov. 4, 2010

(51) Int. Cl.

| | |
|---|---|
| ***F02B 71/04*** | (2006.01) |
| ***F02B 71/00*** | (2006.01) |
| ***F02B 75/32*** | (2006.01) |
| ***F04B 35/00*** | (2006.01) |

(52) U.S. Cl. ..... 123/46 R; 123/197.1; 417/364; 417/380

(58) Field of Classification Search ..... 123/46 R; 417/364, 380

See application file for complete search history.

(56) References Cited

U.S. PATENT DOCUMENTS

| | | | | | |
|---|---|---|---|---|---|
| 3,369,733 | A * | 2/1968 | Campbell | 417/341 |
| 4,167,922 | A * | 9/1979 | Doundoulakis | 123/46 R |
| 4,189,958 | A * | 2/1980 | Braun | 74/606 R |
| 4,369,021 | A * | 1/1983 | Heintz | 417/364 |
| 4,873,822 | A * | 10/1989 | Benaroya | 60/805 |
| 5,464,331 | A * | 11/1995 | Sawyer | 417/364 |
| 5,616,010 | A * | 4/1997 | Sawyer | 417/364 |
| 6,554,585 | B1 * | 4/2003 | Maracchi | 417/364 |
| 6,948,459 | B1 * | 9/2005 | Laumen et al. | 123/46 R |
| 6,983,724 | B2 * | 1/2006 | Carlson | 123/46 R |
| 7,258,086 | B2 * | 8/2007 | Fitzgerald | 123/46 R |
| 2003/0124003 | A1 * | 7/2003 | Gray, Jr. | 417/364 |
| 2005/0247273 | A1 * | 11/2005 | Carlson | 123/46 R |
| 2005/0257758 | A1 * | 11/2005 | Peng et al. | 123/46 R |
| 2006/0191501 | A1 * | 8/2006 | Adle | 123/45 R |

* cited by examiner

*Primary Examiner* — Noah Kamen

*Assistant Examiner* — Grant Moubry

(74) *Attorney, Agent, or Firm* — David H. Read

(57) ABSTRACT

A quasi free piston engine uses, a small, lightweight crankshaft to connect the piston assemblies of the free piston engine with a flywheel. While most of the power output from the combustion pistons is extracted by pumping pistons as hydraulic power, the small crankshaft and flywheel ensure exact TDC position of the combustion pistons in operation, and provide a rotating means to drive combustion cylinder intake and exhaust valves. Flywheel speed may be monitored to provide feedback on power extraction for further control of the system. In addition, a hydraulic push-rod system for efficient valve actuation is provided.

10 Claims, 10 Drawing Sheets

QUASI FREE PISTON ENGINE

FIELD OF INVENTION

The present invention relates to the conversion of chemical energy (fuel) into hydraulic, electric, or pneumatic energy, particularly by means of free-piston internal combustion engines. The general field of application is the efficient production of hydraulic, electric or pneumatic power for mobile and non-mobile power needs.

BACKGROUND OF THE INVENTION

1. Free Piston Engines in General

Hydraulic power is frequently produced by rotating the drive shaft of a hydraulic pump by means of a rotational power source such as an electric motor or an internal combustion engine. The most efficient such pumps utilize a reciprocating-piston design in which the rotational power delivered to the drive shaft is converted to a linear motion of a set of pumping pistons that pump fluid and thereby create hydraulic power. When a conventional internal combustion engine is employed to drive the pump, the rotational drive power it delivers to the pump must also be converted from an originally linear motion of its combustion pistons to the rotational motion required by the pump. Conventional engines employ many parts (such as a crankshaft) to achieve this conversion. The crankshaft also provides a convenient means to achieve several ancillary functions such as: controlling the limits of movement of the combustion pistons, synchronizing and powering valve actuation by rotationally driving a camshaft or similar device, and providing inertia to help ensure each compression stroke will be completed.

The idea of directly coupling the linear motion of the engine combustion piston to the linear motion of the hydraulic piston to produce hydraulic power directly, and thereby avoid the weight and cost of the additional parts and inefficiencies (e.g., through friction losses) of converting linear motion to rotational motion and back again, is not new. In particular, free-piston engines have been considered as a means to directly convert the linear motion of a combustion piston to the linear motion of a pumping piston and thereby convert the majority of the engine's power output to hydraulic power without the need for the intermediate power-converting function of a crankshaft.

For purposes of the present application, a true free piston engine is defined here as an engine where the combustion pistons are not mechanically connected to a crankshaft or similar device. In contrast, a "quasi free piston engine," as defined herein, which is also a direct-pumping engine like a true free piston engine, shall refer to an engine in which a majority of the engine's power output is taken out through a direct-pumping action similar to a true free piston engine, but in which the combustion pistons may nevertheless be mechanically connected to a crankshaft if desired. Unless otherwise indicated, true free piston engines and quasi free piston engines are both encompassed herein by generic references to a free piston engine.

In a true free piston engine, the absence of a crankshaft assembly means that the ancillary functions normally performed by it must be achieved by other means. Therefore one major challenge is how to control the exact stopping point of the piston assembly as it approaches the top dead center (TDC) position of the combustion piston during its compression stroke, (and more problematic, the exhaust stroke for a four-stroke configuration) in a way that is accurate and repeatable (for millions of events). A similar challenge is associated with the control of the exact stopping point of the assembly as it approaches the bottom dead center (BDC) position of the combustion piston during the expansion or power stroke. This is especially so since the friction of each stroke can vary (especially during warm-up or transient operation), the quantity of fuel provided for each combustion event can vary, the beginning of the combustion process can vary, the rate of combustion and its completeness can vary, the pressure of the hydraulic fluid being supplied to the pump can vary, the pressure of the hydraulic fluid being expelled can vary, and many other operating parameters that influence each stroke can vary; therefore, the accurate control of the TDC and BDC positions is very challenging. The consequences of inadequate control can go beyond unacceptable performance and be destructive to the engine, such as if the combustion piston hits the cylinder head of the combustion chamber or the pumping piston contacts the end of the pumping chamber.

Because of the challenges posed by operational control, most true free piston engines of the prior art operate on a two stroke cycle rather than a more desirable four-stroke cycle. A two-stroke dual piston configuration eliminates separate intake and exhaust strokes, and allows the compression stroke to be powered directly by the expansion stroke, obviating the need for crankshaft inertia to complete the cycle. Even on a two stroke cycle, stoppage of the combustion piston at the correct position at TDC during the compression stroke remains difficult. A four-stroke configuration would require a means to power the additional intake strokes and every other exhaust and compression stroke. The exhaust stroke poses a special difficulty because, unlike the compression stroke, there are no trapped gases to decelerate the combustion piston as it moves toward TDC, making it even more difficult to avoid hitting the cylinder head.

2. The Gray '204 Free Piston Engine

Multiple embodiments of a true free piston engine, including four-stroke true free piston engines, are disclosed and described in U.S. Pat. No. 6,582,204 to Gray. For purposes of better understanding the present invention, the Gray '204 engine will be briefly redescribed in part herein (with reference to FIGS. 1-5 which are reproduced from the '204 patent), with additional detail from the patent incorporated by reference.

FIGS. 1 and 2 show cross sectional views (in perpendicular planes) of a preferred embodiment of the '204 patent, comprising a single dual piston assembly included in a free piston engine unit. Cylinders 12 are part of the engine structure (not further shown). An igniter 120 and a fuel injector 121 are illustrated but intake and exhaust valves/ports and other conventional features of internal-combustion two stroke and four stroke cycle engines, while present, are not shown. Opposed combustion pistons 13 and 14 slide within cylinders 12. Combustion pistons 13 and 14 respectively have axially and inwardly attached pumping pistons 15 and 16 which slide within pumping cylinders 17 and 18. Single free-piston assembly of combustion piston 13 and pumping piston 15 and single free-piston assembly of combustion piston 14 and pumping piston 16 are attached by a rigid means external to the pumping pistons.

FIG. 1 shows an external cage 19 for rigidly so connecting the two single free-piston assemblies to form a dual piston assembly which reciprocates as a single unit comprising combustion pistons 13 and 14 and pumping pistons 15 and 16 and cage 19. A free-piston engine unit includes one such dual piston assembly plus the associated combustion and hydraulic cylinders. FIG. 3 shows a configuration of the dual piston assembly in perspective to assist in visualizing the cage structure 19 with the combustion pistons 13 and 14. In this configuration, the cage 19 is extended (or "bowed") out beyond the diameter of the combustion pistons 13 and 14.

Cage 19 provides for a rigid structure to avoid bending of the assembly associated with the large acceleration and deceleration forces that occur with each stroke. A rigid structure and optional bushings 20 (FIG. 1) provide for accurate positioning and close clearances of combustion pistons 13 and 14 within cylinders 12 so that operation with low friction, ringless combustion pistons is preferably feasible. Bushings 20 react against any secondary combustion piston side forces, and the rigid cage 19 prevents bending which would otherwise allow piston side movement.

FIG. 2 is a cross-sectional view of the assembly of FIG. 1 rotated 90 degrees. Pumping cylinders 17 and 18 contain ports which respectively communicate with hydraulic lines 22 and 23, which contain valves 24*a* and 24*b*, which further connect with passage 25 through valve 32, with passage 25 further connected to a low pressure hydraulic fluid source. Pumping cylinders 17 and 18 respectively also communicate with passages 26 and 27 which have one-way check valves 28*a* and 28*b*, which further connect with passage 29 (through optional valve 33), with passage 29 in communication with a high pressure hydraulic fluid receptor such as a high pressure hydraulic accumulator, or for use of the pressurized fluid in a hydraulic motor. On/off valves 30*a* and 30*b* are used to provide high pressure fluid to pumping cylinders 17 and 18 for starting the engine.

To start the engine, the dual piston assembly will be in the position as shown on FIGS. 1 and 2. (Valve 30*b* is an optional valve to provide more flexibility in starting the engine from different initial positions, e.g., if combustion piston 14 is at BDC instead.) Valve 30*a* is commanded to open and high pressure fluid flows through open optional valve 33 from passage 29, through valve 30*a*, through passage 26, and into pumping cylinder 17. High pressure fluid within cylinder 17 acts on the cross sectional area of pumping piston 15, producing a force which accelerates the dual piston assembly and combustion piston 13 toward TDC. After valve 30*a* has been commanded to shut-off, the inertia of the dual piston assembly will continue to increase the volume in the pumping cylinder 17, and valve 24*a* will open in a check-valve manner (or on command) permitting low pressure fluid to flow through open valve 32 from passage 25, through valve 24*a*, through passage 22 and into cylinder 17, until piston 13 reaches TDC and combustion occurs. During the start-up stroke, valve 24*b* is commanded open (and valve 30*b* if present, is commanded shut). This allows fluid in cylinder 18 to be displaced through passage 23, through valve 24*b*, through valve 32 and through passage 25, avoiding resistance to the start-up compression stroke.

After combustion, as the dual piston assembly is accelerated by the force of the combustion gases on the cross sectional area of piston 13, the engine control unit (ECU) commands valve 24*a* to shut-off, so as to achieve fluid flow under pressure from cylinder 17 through check valve 28*a* and optional valve 33 to passage 29, thus producing hydraulic power output.

In the '204 patent, position sensors are disclosed to determine velocity and acceleration, and determine when to command valve closure. The ECU determines in real time the available energy produced from each combustion event from the velocity of the dual piston assembly mass and the forces still being applied to it (determined by the acceleration) at each position, considers the frictional energy consumption from characterization maps, and determines the power stroke of the pumping piston needed to achieve a dual piston assembly stoppage position so that the compressing combustion piston achieves the real time specified compression ratio for the next combustion event. The ECU then commands the fluid intake valve (valve 24*a* or 24*b* as appropriate) to close at that position intended to achieve the needed pumping piston power stroke.

FIG. 4 shows an additional embodiment of the '204 patent wherein the single dual piston assembly of FIGS. 1-3 is balanced. The dual piston assembly 60 is shown with gear teeth 61*a* and 61*b*, gears 62*a* and 62*b* that rotate about fixed points 90*a* and 90*b* respectively, and, interfacing with gears 62*a* and 62*b*, balance masses 63*a* and 63*b*. Balance masses 63*a* and 63*b* are of equal mass and each is one-half the mass of the dual piston assembly 60. As dual piston assembly 60 moves in one direction, the balancing masses 63*a* and 63*b* are driven by gears 62*a* and 62*b* to move at the same velocity in the opposite direction. In this embodiment, the single dual piston assembly true free-piston engine is both mass and moment balanced. As will be understood, the gear rack and pinion means in FIG. 4 can also be replaced with a chain/sprocket, lever or other similar synchronization means if desired.

As shown in the '204 patent, mechanically balanced four and eight cylinder dual piston assemblies in the true free piston engine configurations can be also be operated in a four stroke cycle. It will be helpful in understanding the invention to review the sequence of strokes in such a configuration. FIGS. 5*a*-5*d* present a simplified view of the stroke sequence in a four-stroke, four-cylinder, dual piston assemblies in the true free piston engine according to the '204 patent. In FIG. 5*a*, one of the dual piston assemblies undergoes an expansion stroke at one end and a compression stroke at the other. The other dual piston assembly is undergoing an intake stroke at one end and an exhaust stroke at the other. FIGS. 5*b*-5*d* illustrate the additional sequence of strokes that would complete the four-stroke cycle for the engine. Because the piston assemblies are geared together in a way similar to the gearing in FIG. 4, the expansion stroke powers all other strokes. The hydraulic pumping pistons and cylinders may be included with each dual piston assembly as shown, or be included with only one dual piston assembly of the four cylinder configuration of FIG. 5 in a four stroke operating cycle. As is well known in the art, each stroke must be accompanied by rapid and accurately timed actuation of properly placed intake valves and exhaust valves. The remainder of the description in the '204 patent need not be repeated and is instead incorporated herein by reference.

3. Other Free Piston Prior Art

U.S. Pat. No. 4,441,587 to Patten mentions possible use of a crankshaft of reduced mass with a free piston engine to synchronize operation of the piston assemblies, but teaches away from the use of the crankshaft to limit or control piston travel or to transfer energy developed within the combustion chamber. Patten instead provides a novel braking system to prevent piston overtravel. Patten does not provide a flywheel to assist in supplying energy for carrying out the compression stroke to avoid power-down (i.e., in the event that combustion energy from the expansion stroke of the opposing piston is insufficient to fully power the corresponding compression stroke). Because Patten concerns itself only with providing a braking means for piston overtravel, Patten presumably provides an additional fuel increment to be sure that power down does not occur due to variabilities in combustion. Such overfueling wastes fuel and is inefficient, as it would be more desirable to target the "right" amount of fuel for the combustion as long as it is possible to ensure desired TDC position in the movement of the pistons.

In addition, an internal combustion engine driving a crankshaft for a conventional vehicle drivetrain, but with a floating free piston in an auxiliary chamber for reducing peak combustion pressures and pumping fluid is disclosed in U.S. Pat. No. 5,611,300.

4. Challenges of the Prior Art

One challenge that remains with free piston engines is the difficulty in ensuring exact TDC position in the movement of the pistons.

For example, while the apparatus and methods of the Gray '204 patent have proven successful in providing operating control of a four stroke free piston engine, it has become desirable to ensure highly exact TDC positioning of the pistons in combustion in order to further improve the efficiency of the free piston engine. In particular, it has been found with the Gray device that even relatively small variability in the piston position requires operating the engine with a safety zone for the squish volume at TDC of greater than 1 millimeter, which has the undesirable effect of reducing the compression ratio and efficiency of the engine. Further, it has been found that if the engine is operated with a smaller squish volume (e.g. 0.5 mm), the variability can result in the combustion pistons hitting the cylinder head at higher engine speeds (e.g., above 2500 cycles per minute). It is instead desirable to be able to keep the squish volume down to a level below 1 millimeter, for better efficiency, but without resulting in hitting the cylinder head, thus requiring more exact TDC stopping positions.

In addition, it is also desirable to provide for efficient and reliable actuation of the intake and exhaust valves. Crankshaft and camshaft architecture for valve actuation in conventional engines is absent in a true free piston engine. Hydraulic actuation of the intake and exhaust valves of a free piston engine is also known, but involves significant energy loss. Applicant has found that a more efficient hydraulic valve actuation could further improve efficiency of a free piston engine by 2%-3%.

OBJECT OF THE INVENTION

Accordingly, it is one object of the present invention to provide an efficient means for ensuring exact stoppage of combustion and pumping pistons at appropriate top dead center and bottom dead center positions in a free-piston engine.

A second object of the present invention is to provide an efficient valve actuation structure and method for a free-piston engine.

SUMMARY OF THE INVENTION

In order to achieve the foregoing objectives, a small and lightweight crankshaft connects the piston assemblies of the free piston engine with a flywheel, thereby providing a quasi free piston engine. While most of the power (e.g., up to 99% of the power output) from the combustion pistons is still extracted by the pumping pistons in the direct pumping action of a true free piston engine, the small crankshaft and flywheel nevertheless serve to ensure exact TDC position. Flywheel speed may additionally be monitored by a speed sensor, to provide feedback on power extraction for further control of the system. In addition, in one embodiment, a novel "hydraulic push-rod" system for more efficient valve actuation is provided. The embodiments disclosed herein encompass both two-stroke and four-stroke configurations.

DETAILED DESCRIPTION OF THE INVENTION

Figure 2:
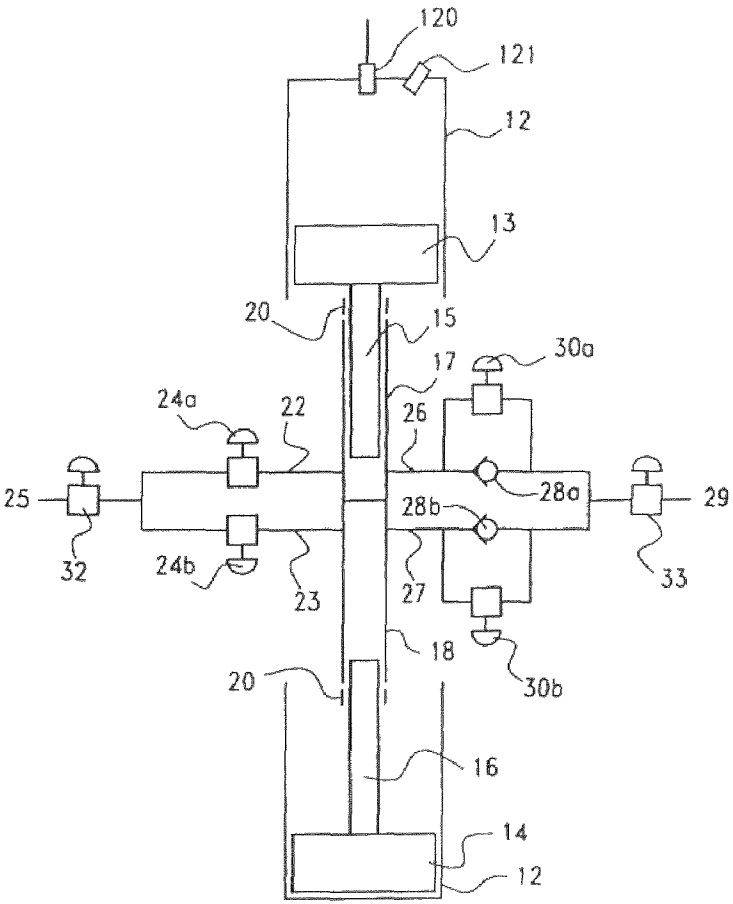
Fig. 2 (Prior Art)
FIGS. 1 and 2 present schematic views of a dual piston free-piston engine as previously disclosed in the Gray '204 patent.
Figure 1:
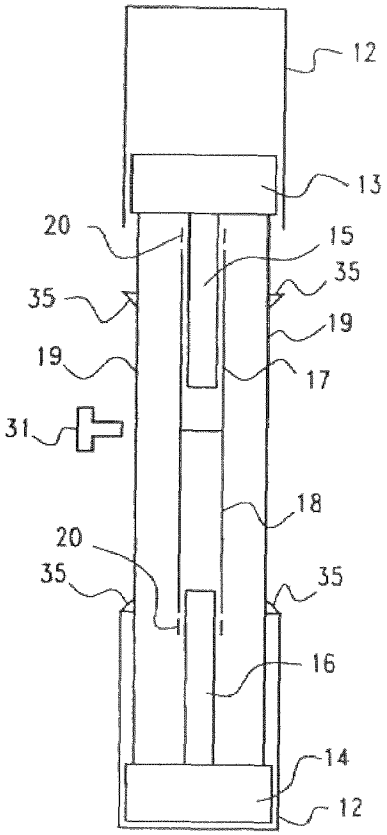
Fig. 1 (Prior Art)
Figure 3:
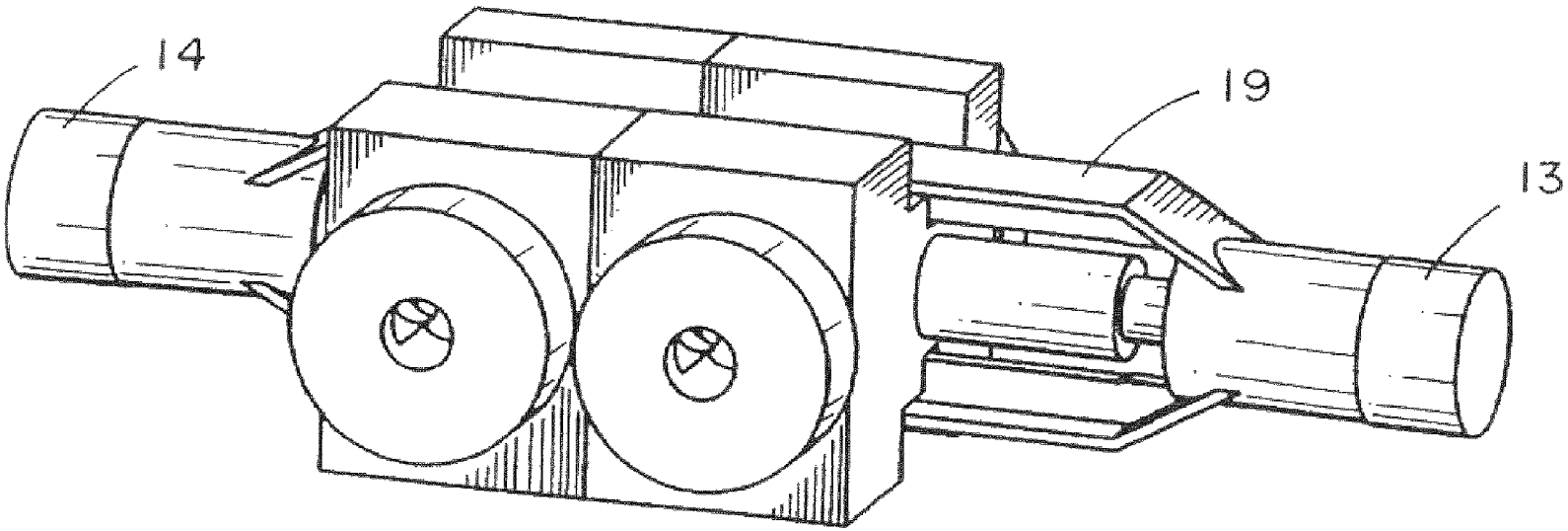
Fig. 3 (Prior Art)
FIG. 3 presents an exterior view of the free-piston engine of FIGS. 1-2.
Figure 4:
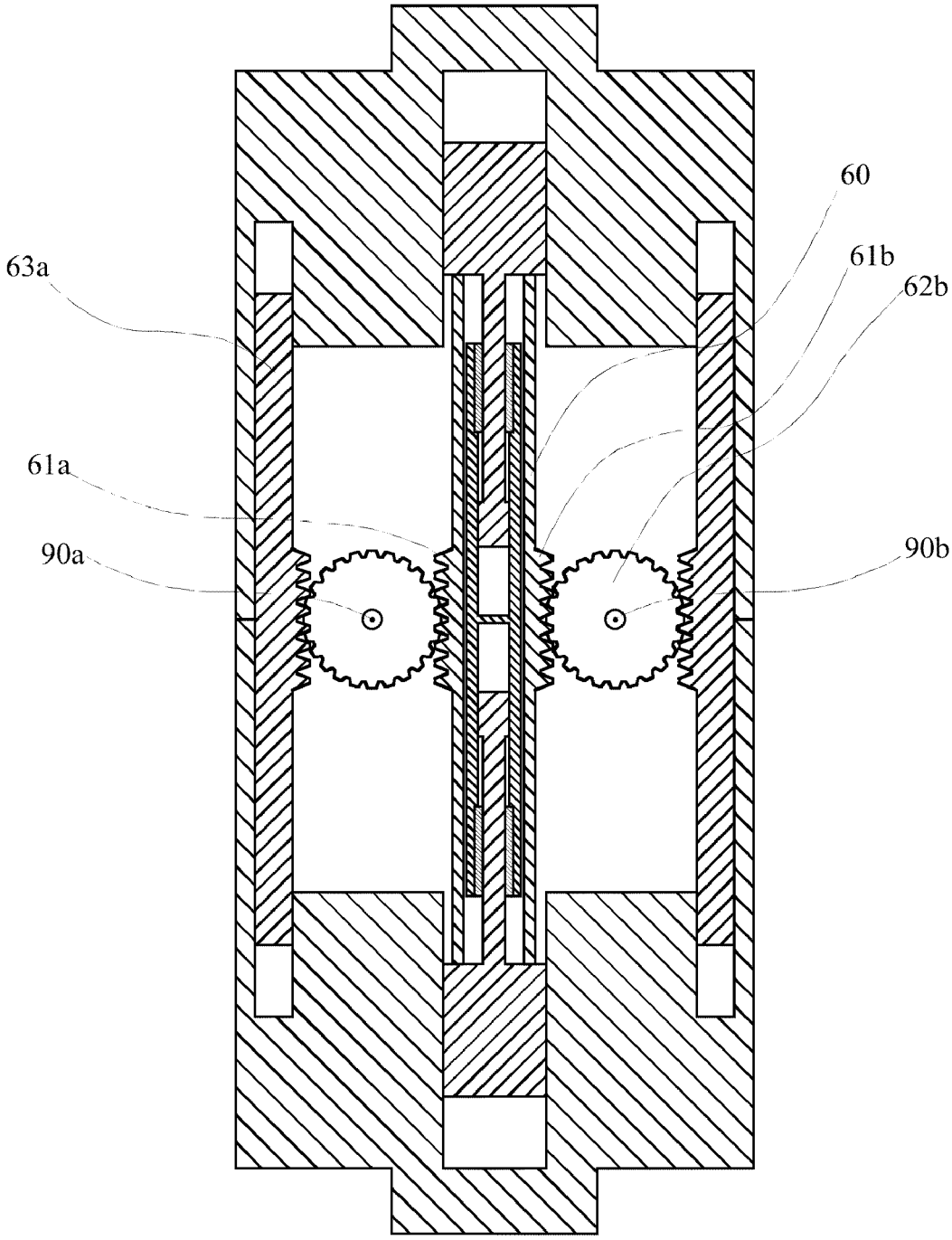
Fig. 4 (Prior Art)
FIG. 4 presents an alternative embodiment of a dual piston free-piston engine disclosed in the Gray '204 patent.
Figure 5A:
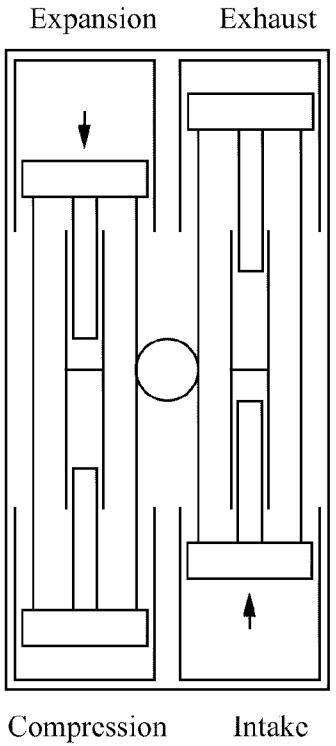
Fig. 5a (Prior Art)
FIG. 5 presents a schematic view of the sequence of strokes in a four-stroke, four-cylinder configuration according to the Gray '204 patent.
Figure 5B:
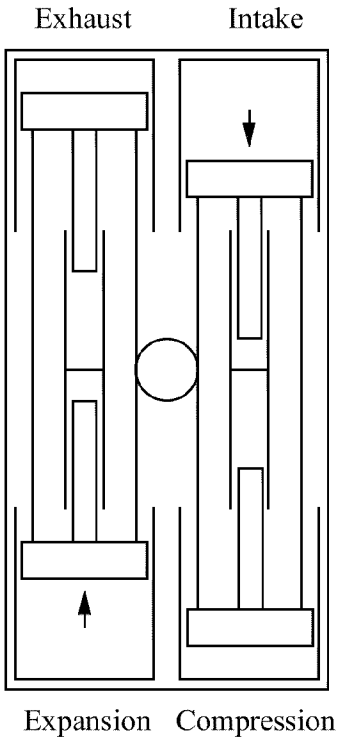
Fig. 5b (Prior Art)
Figure 5C:
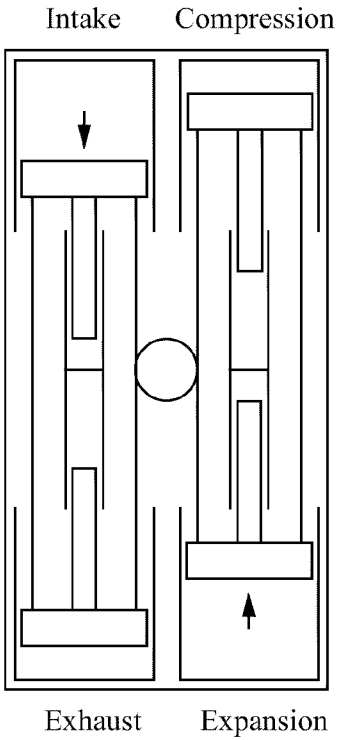
Fig. 5c (Prior Art)
Figure 5D:
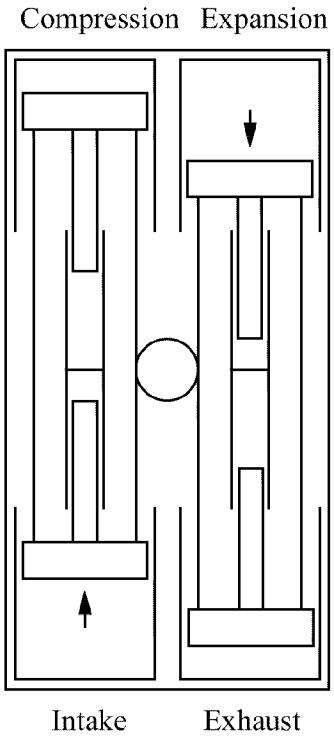
Fig. 5d (Prior Art)
Figure 6:
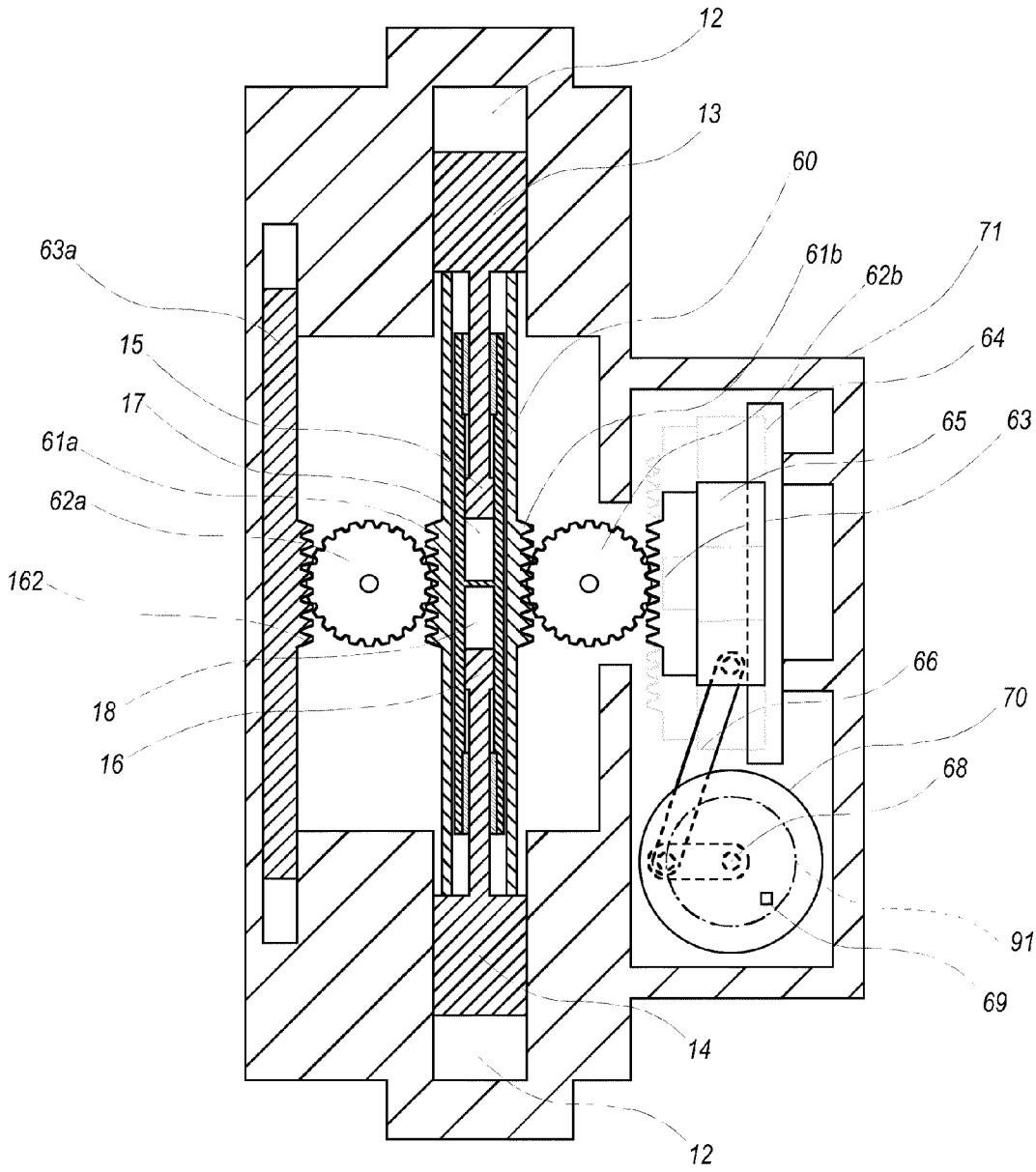
FIG. 6 presents a cross-sectional view of a preferred embodiment of a two-stroke quasi free piston engine of the present invention.

A cross-sectional view of a preferred embodiment of a two-stroke quasi free piston engine of the present invention is presented in FIG. 6. The quasi free piston engine of FIG. 6 operates similarly to the free piston engine of FIG. 4. Opposed combustion pistons 13 and 14 slide within cylinders 12 that reside in block 71. Combustion pistons 13 and 14 respectively have axially and inwardly attached pumping pistons 15 and 16 which slide within pumping cylinders 17 and 18. Pumping cylinders 17 and 18 are directly analogous to the same numbered components of FIG. 2; their respective fluid connections, not as easily shown in FIG. 5, will be best understood with reference to FIG. 2. Pumping cylinders 17 and 18 respectively communicate with hydraulic lines 22 and 23 which contain valves 24*a* and 24*b*, which further connect with passage 25 through valve 32, which passage is further connected to the low pressure hydraulic fluid source (hydraulic lines, valves, and fluid source not shown in FIG. 6). Pumping cylinders 17 and 18 respectively also communicate with passages 26 and 27 which have one-way check valves 28*a* and 28*b*, which further connect with passage 29 (through optional valve 33) in communication with a high pressure hydraulic fluid receptor such as a high pressure hydraulic accumulator, or for use of the pressurized fluid in a hydraulic motor (hydraulic lines, valves, and fluid source not shown in FIG. 6).

As with FIGS. 1-4, after combustion, as the dual piston assembly is accelerated by the force of the combustion gases on the combustion surface area of piston 13, the ECU commands valve 24*a* to shut-off, so as to achieve fluid flow under pressure from cylinder 17 through check valve 28*a* and optional valve 33 to passage 29, thus producing hydraulic power output.

However, it will be noted that the quasi free piston engine of FIG. 6 differs from the true free piston engine of FIGS. 1-4 in significant ways. For example, combustion pistons 13 and 14 are connected via rack 61*b*, gear 62*b*, rack 63, guiding members 64, weight 65, and connecting rod 66 to small crankshaft 68. Alternatively, gear 62*b* could be eliminated and a more direct connection could be used between the piston assembly and connecting rod 66. Crankshaft 68 extends perpendicularly from the page in FIG. 6, and is configured to drive a flywheel 70. Dimension-wise, crankshaft 68 may be, for example, 25% of the size normally used for a similar displacement conventional engine (preferably crankshaft 68 is 50% or less of the size normally used for a similar displacement conventional engine). As in the free piston engine of FIGS. 1-4, most (and up to 99%) of the power output from combustion for the quasi free piston engine of FIG. 6 in each power stroke is extracted through the pumping pistons 15 and 16 pressuring fluid and thereby converting the power to hydraulic power output.

As the combustion piston 13 in the power stroke approaches BDC, with its linked combustion piston 14 approaching TDC, or vice versa, any residual power not extracted by the pumping piston will cause rotation of the crankshaft 68, which in turn will drive flywheel 70. By appropriate sizing of the radius of crankshaft orbit 91 to effect the desired stroke of pistons 13 and 14, this connection of the various pistons of the quasi free piston engine to the crankshaft 68 provides a reliable desired stopping point for the combustion pistons in a similar manner as for a conventional engine, thereby enabling desired compression ratio and squish volume for efficient operation as well. Conversely, if too much power is extracted by the pumping piston 15 or 16, the inertia of flywheel 70 and the crank system (i.e., crankshaft 68, connecting rod 66, weight 65, and gearing mechanism 63 and 62*b*) will help move the piston assembly through the compression stroke to the proper TDC position for the next stroke to begin. Thus the flywheel 70 acts as a buffer against cycle-to-cycle variability as hydraulic power is extracted.

Guidance members 64 provide a guidance means for weight 65 and related components. Preferably guidance members 64 are of a smooth rail-like form, rigidly attached to block 71 and providing one or more smooth linear surfaces upon which one or more linear recesses on weight 65 may axially slide. Alternatively, the guidance means could be a rolling contact, such as a roller bearing situated between weight 65 and an inner surface of the block 71 or similarly rigid surface, or any other sliding or rolling means. The weight and dimensions of balancing member 63*a* are selected to counteract the weight and movements of gearing mechanism 63 and weight 65, and related components of the crank section, to provide mechanical balancing for the engine.

It should be noted that only minimal side forces are introduced by the crank system because most of the energy is taken out by the pumping piston and because of the small mass of the crankshaft 68.

Flywheel 70 may be configured either to rotate at the same speed as crankshaft 68, or to freewheel. As an incidental benefit of the engine of FIG. 6, energy that is temporarily stored in the flywheel may be used for other purposes in the vehicle if desired, such as to drive accessories.

A speed sensor 69 may be positioned on the crankshaft 68 or flywheel 70 (or in alternative locations to allow determination of rotational velocity, acceleration, or position of the crankshaft and/or flywheel). Signals from sensor 69 may be transmitted to an engine control unit (not shown) for the quasi free piston engine, to provide information which may then be used for engine control purposes. In particular, a feedback loop to adjust fuel feed for the engine, or to adjust the hydraulic power extraction, may be established. For example, if signals from sensor 69 indicate an acceleration or increased velocity of the crankshaft 68 or flywheel 70, that would indicate an excess of fuel feed in the prior combustion cycle, and the ECU could then send the appropriate signal to reduce fuel feed for the following combustion event.

The method of attaining a four-stroke, four- or eight-cylinder mechanically balanced configuration by combining multiple free-piston engine assemblies, as well established by the Gray '204 patent, applies as well to the quasi free piston engine. It will therefore be understood that multiple piston assemblies may be mechanically coupled, such as for example by gear and rack, such that the assemblies are balanced and synchronized. In such case, just one connection to the crankshaft is needed to control stopping position of pistons for all of the multiple potential combustion cylinders.

Figure 7:
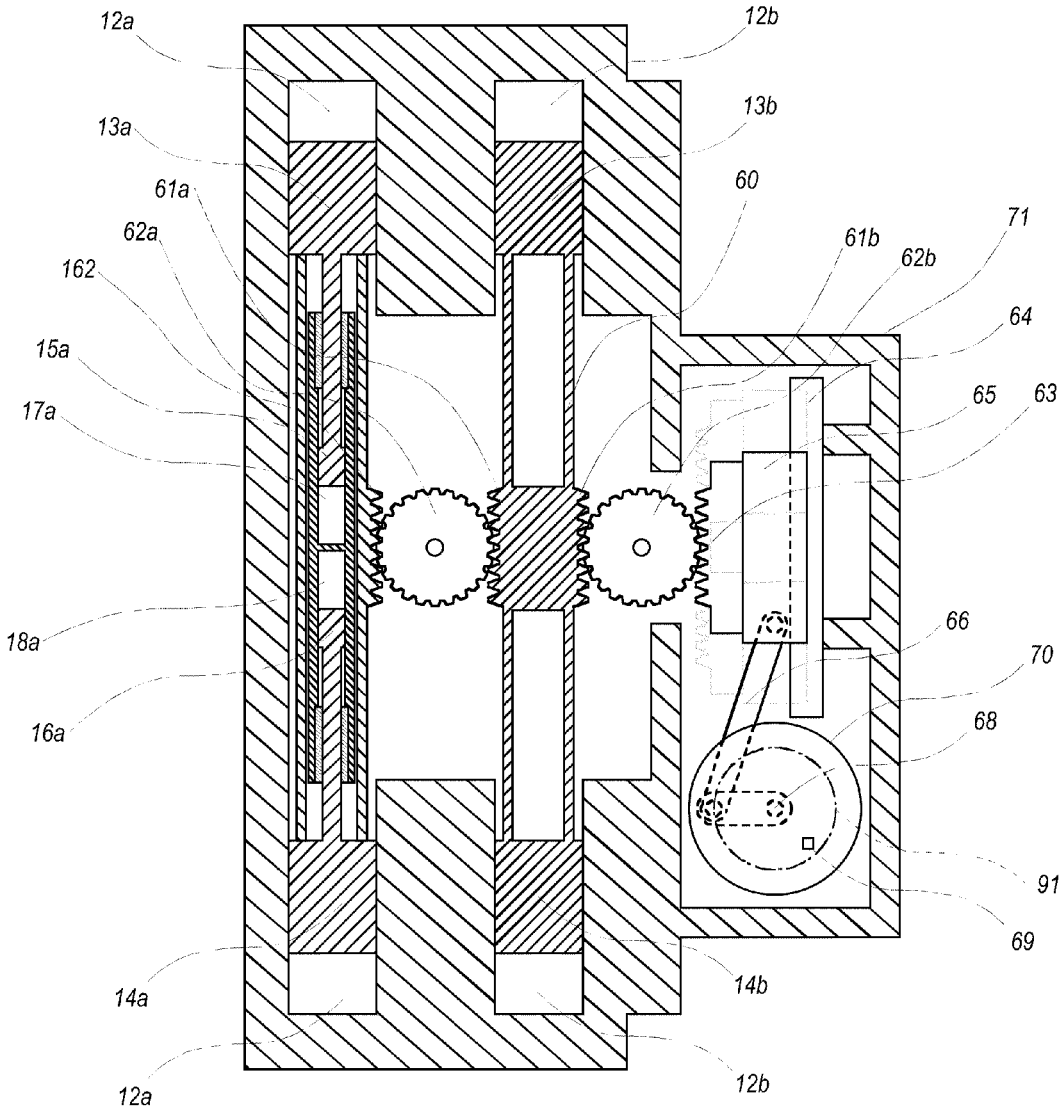
FIG. 7 presents a preferred embodiment of a four stroke, four cylinder quasi free piston engine of the present invention.

FIG. 7 depicts an example of such a configuration for four stroke operation. A first piston assembly includes combustion pistons 13*b* and 14*b*. Balance member 63*a* of FIG. 6 is replaced by a second dual piston assembly that includes combustion pistons 13*a* and 14*a*, pumping pistons 15*a* and 16*a*, and pumping cylinders 17*a* and 18*a*. As the mass of the second piston assembly offsets the mass of the original assembly, a separate balance member is no longer required. Optionally, the mass of either piston assembly may be adjusted in order to balance the mass of the crank assembly.

Figure 8:
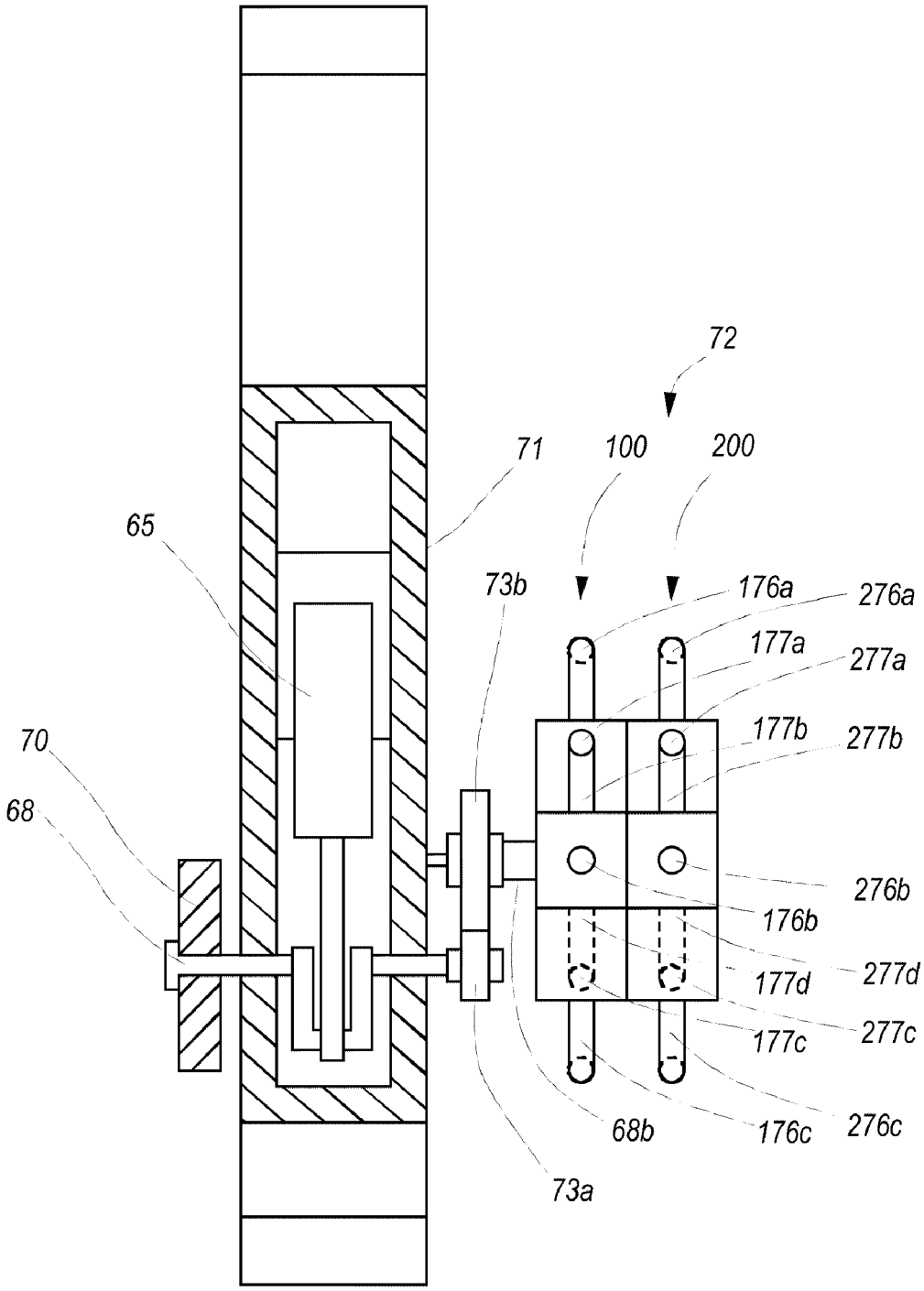
FIG. 8 presents a side cross sectional view of the engine of FIG. 7.

Referring now to an embodiment of additional features of the engine as shown in FIG. 8, optional hydraulic pump 72 is configured to be driven by crankshaft 68 (and through optional gearing mechanism 73*a* and 73*b* and shaft 68*b*). Crankshaft 68 could alternatively drive hydraulic pump 72 by belts or other common means. Hydraulic pump 72 provides for actuation of engine intake and exhaust valves in a manner to be described. As indicated in FIG. 8, crankshaft 68 (or shaft 68*b* geared thereto) provides hydraulic pump 72 with rotational input power. Optional gearing mechanism 73*a-b* and shaft 68*b* are shown as they would act in a four-stroke, four-cylinder application, which requires that cam 74 of FIGS. 9-11 rotate at a speed one-half that of the crankshaft 68. Hydraulic pump 72 is seen here by way of example to include two actuator banks 100 and 200 which have various fluid ports indicated as 176-177 and 276-277 that provide for valve actuation in a manner to be described.

Figure 9:
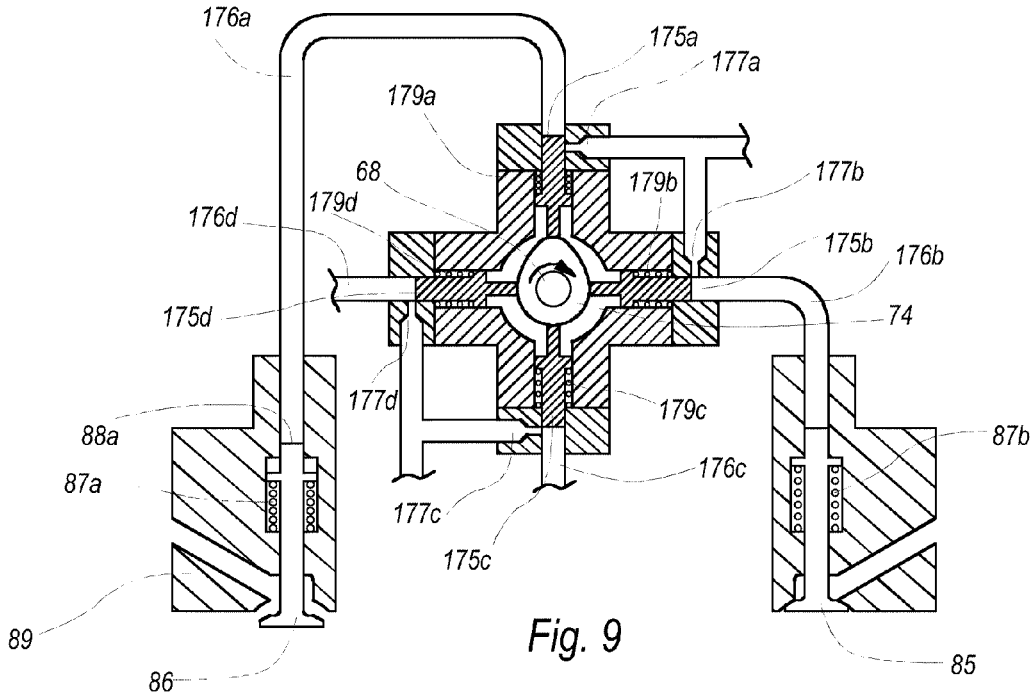
FIG. 9 presents a cross sectional view of the cam-driven hydraulic pump section of FIG. 8 in which a valve is actuated.
Figure 10:
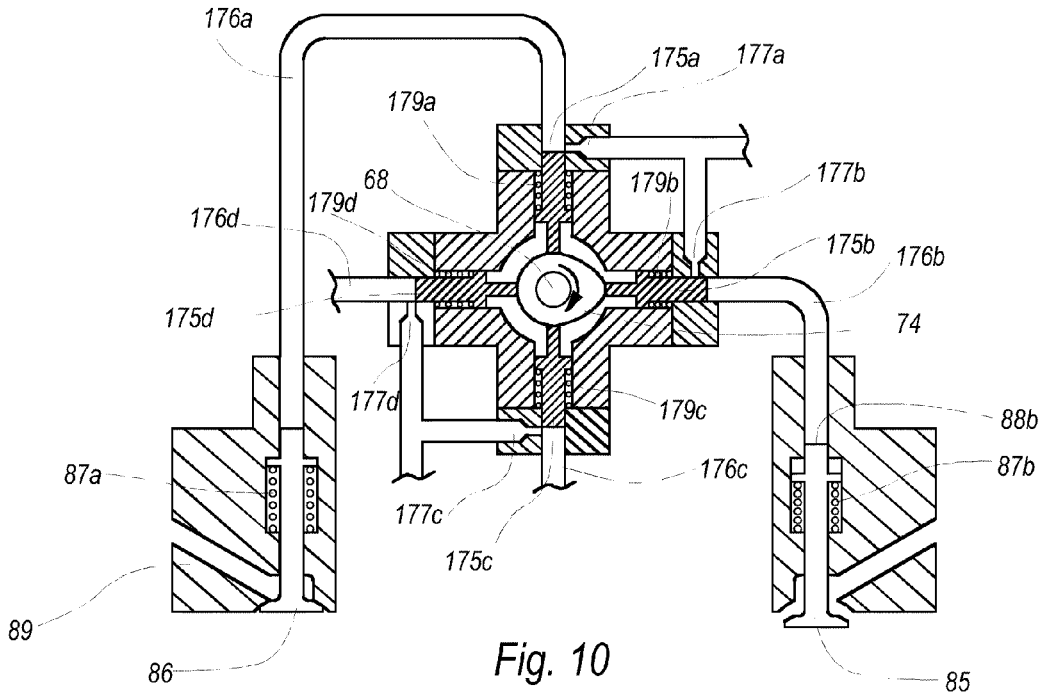
FIG. 10 presents a cross 'sectional view of the cam-driven hydraulic pump section of FIG. 8 in which a different valve is actuated.

FIGS. 9 and 10 describe the operation of the hydraulic pump in a sectional view orthogonal to that of FIG. 8 and intersecting actuator bank 100. Referring to FIG. 9, it can be seen that hydraulic lines 176*a* and 176*b* are connected to representative hydromechanical surfaces 88*a* and 88*b* of engine valves 85 and 86. Valves 85 and 86 represent intake and/or exhaust valves as would be provided in a combustion chamber of the invention. Hydraulic lines 176*c* and 176*d* are similarly connected to additional valves but they are omitted for clarity. Ports 177*a-d* are connected to a fluid supply source to maintain a constant fluid volume compensating for any fluid leakage out of hydraulic lines 176*a-d*.

Crankshaft 68 rotationally drives cam 74. Pistons 175*a-d* are biased to a default position and retained by return springs 179*a-d*. In this default position, low pressure ports 177*a-d* are exposed to a low pressure fluid source (not shown) to maintain fluid volume in the respective line. As cam 74 rotates, it sequentially engages each of pistons 175*a-d*, causing respective return springs 179*a-d* to compress, and causing the respective linear displacement of the respective pistons into the fluid-occupied space of respective hydraulic lines 176*a-d*, and the resultant displacement of fluid toward, and transmittal of force upon, the respective valve hydromechanical surfaces to which they connect. On displacement of a piston 175*a-d*, respective low pressure port 177*a-d* becomes closed off by the piston to ensure that fluid trapped in the respective line may not escape via the low pressure supply path. Alternatively, a one-way check valve may be provided at appropriate points in the low pressure supply path to serve the same purpose, and the low pressure ports 177*a-d* may remain exposed.

Following FIG. 9, valve 85 is biased closed by spring 87*b*, and valve 86 is biased closed by spring 87*a*. Cam 74, having rotated into the depicted position, causes forward motion of piston 175*a*, and a corresponding volume of fluid, into hydraulic line 176*a*. Because the fluid in hydraulic line 176*a* is relatively incompressible, the force exerted on piston 175*a* is transmitted through hydraulic line 176*a* and acts on a first surface 88*a* of valve 86 to overcome the biasing force of spring 87*a*, and thereby causes valve 86 to lift from cylinder head 89 and open the port to the combustion cylinder.

Referring now to FIG. 10, which is the same sectional view of actuator bank 100, cam 74 has rotated to a new position where it now engages piston 175*b*. Accordingly, piston 175*a* is no longer engaged with cam 74, has retreated to its default position by force of its return spring 179*a*, and the biasing force of spring 87*a* has returned valve 86 to its closed position. As valve 86 returned to a closed position, most of the energy previously stored in spring 87*a* as the hydraulic actuating force overcame its biasing force was returned to cam 74 via the fluid link as valve 86 displaced fluid in the return direction. Cam 74 in its new position has engaged piston 175*b* thereby causing it to move forward, thereby resulting in opening of valve 85 in the same manner as described with respect to FIG. 9.

As can be seen, in this manner, the fluid in lines 176*a-d* essentially acts as flexible, fixed-length rods for valve actuation. This fluidic mechanism of valve actuation may be analogized to the traditional mechanical push rods as known in conventional internal combustion engine art. In brief, this traditional mode of action is for a cam driven by a camshaft (which is in turn driven by a crankshaft) to cause lifting of rods which in turn cause rocker arms to cause intake and exhaust valves to lift and close for intake of air and exhaust of combustion gases from the combustion cylinder. The fluidic mechanism is clearly less complex and more efficient than the traditional method which relies on many intricate parts and is subject to many sources of mechanical friction. In addition, as the fluid in lines 176*a-d* is confined to a fixed volume, and is not pressurized and then discharged to lower pressure (as commonly done in camless hydraulic valve actuation systems), the valve actuation becomes more efficient.

The hydraulic valve actuation means described in FIGS. 9-10 provides for asymmetric timing of the intake and exhaust valve openings, if desired. This could be particularly beneficial for 2-stroke free piston engines of all types. Actuator banks 100 and 200 of FIG. 8 may be configured such that one bank actuates only exhaust valves and the other actuates only intake valves; or alternatively, one bank could actuate the exhaust and intake valves of two cylinders while the other bank serves the other two cylinders in the same manner. A two-stroke configuration could utilize a single actuator bank rotating at the same speed as the crankshaft (i.e. without optional gearing 73*a-b* of FIG. 8).

Figure 11:
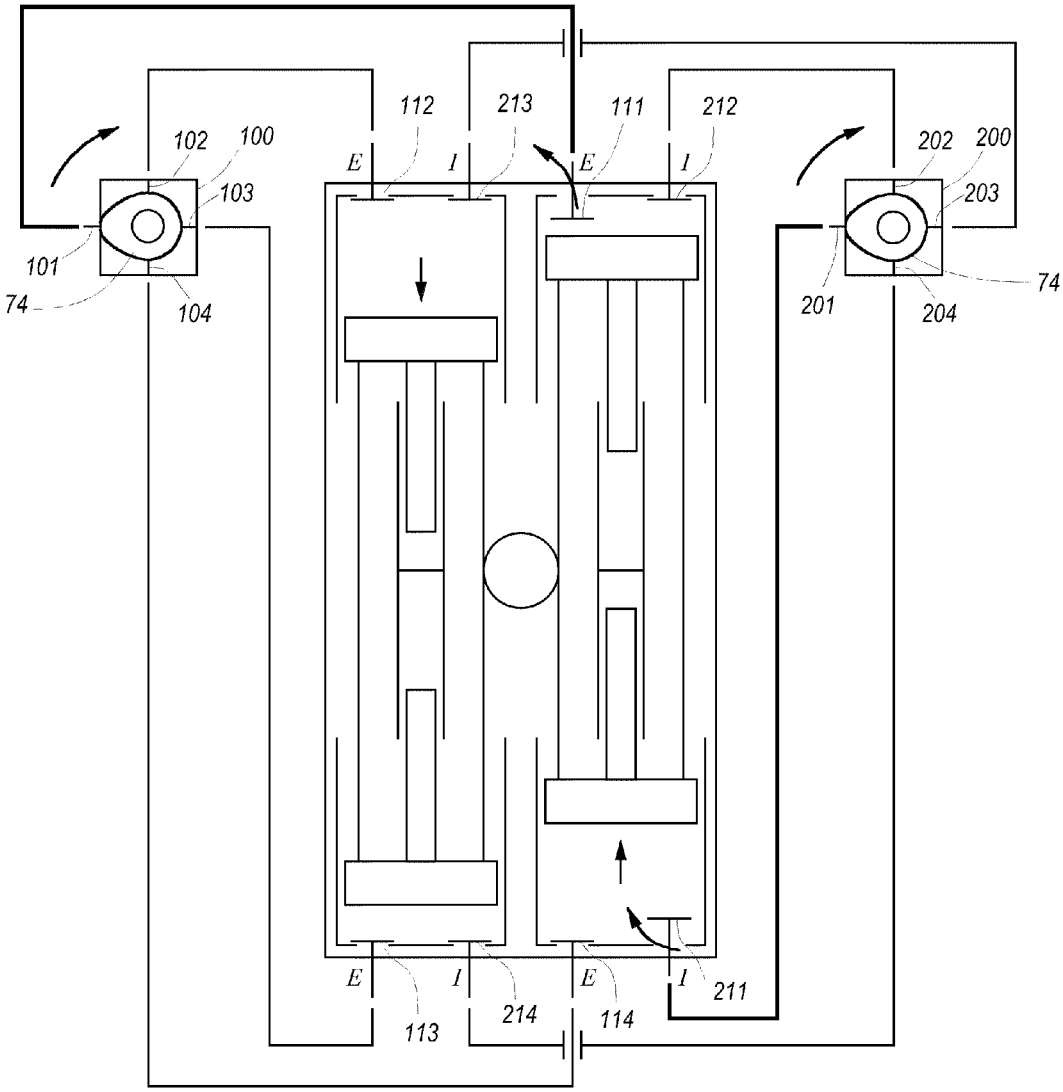
FIG. 11 presents a schematic of a sequence of actuation of intake and exhaust valves in the engine of FIG. 7.

FIG. 11 is a schematic view outlining a manner in which the cam-driven hydraulic pump may be employed to actuate and synchronize the intake and exhaust valves of a four-stroke, four-cylinder embodiment of the invention. FIG. 11 corresponds to FIG. 5*a*, a state in the four-stroke cycle in which the leftmost dual piston assembly undergoes an expansion stroke at one end and a compression stroke at the other, while the rightmost assembly is undergoing an exhaust stroke at one end and an intake stroke at the other. Accordingly exhaust valve 111 and intake valve 211 must be open during the depicted state. To achieve this, actuator banks 100 and 200 are both driven by cam 74. Cam 74 rotates to a position engaging pistons 101 and 201, causing the respective valves 111 and 211 to open. (For clarity of illustration, cam 74 is depicted as fully displacing pistons 101 and 201 in the depicted stage of the stroke, but it will be understood that the exact position of cam 74 at this stage, and in fact its specific shape profile, would depend on the desired valve lift profile for a given application. In an actual application, cam 74 would likely be in a position somewhat clockwise of that depicted, given the relatively late stage of the depicted stroke).

The sequence of valve actuation for the remaining strokes of the four-stroke cycle may be followed by comparing FIGS. 5*b*-5*d* with the schematic of FIG. 11. In FIG. 5*b*, an exhaust stroke occurs at the upper left cylinder and an intake stroke at the upper right, and hence in this state exhaust valve 112 and intake valve 212 must be opened. Accordingly it can be seen in FIG. 11 that this would be achieved by rotation of cam 74 to engage pistons 102 and 202 which actuate the respective valves. In FIG. 5*c*, an exhaust stroke occurs at the lower left cylinder and an intake stroke occurs at the upper left cylinder and hence exhaust valve 113 and intake valve 213 must be opened. Accordingly it can be seen in FIG. 11 that this would be achieved by rotation of cam 74 to engage pistons 103 and 203. Finally, in FIG. 5*d*, an exhaust stroke occurs at the lower right cylinder and an intake stroke at the lower left cylinder and hence exhaust valve 114 and intake valve 214 must be opened, which would be achieved by rotation of cam 74 to engage pistons 104 and 204. Continued rotation of cam 74 once again enters the actuation state necessary for FIG. 5*a*, to continue the four-stroke cycle.

Crankshaft 68 can also alternatively drive a rotary conventional valve actuation cam by gearing, belt or other commonly known means. Valve actuation by direct cam means is well known in prior art.

Figure 12:
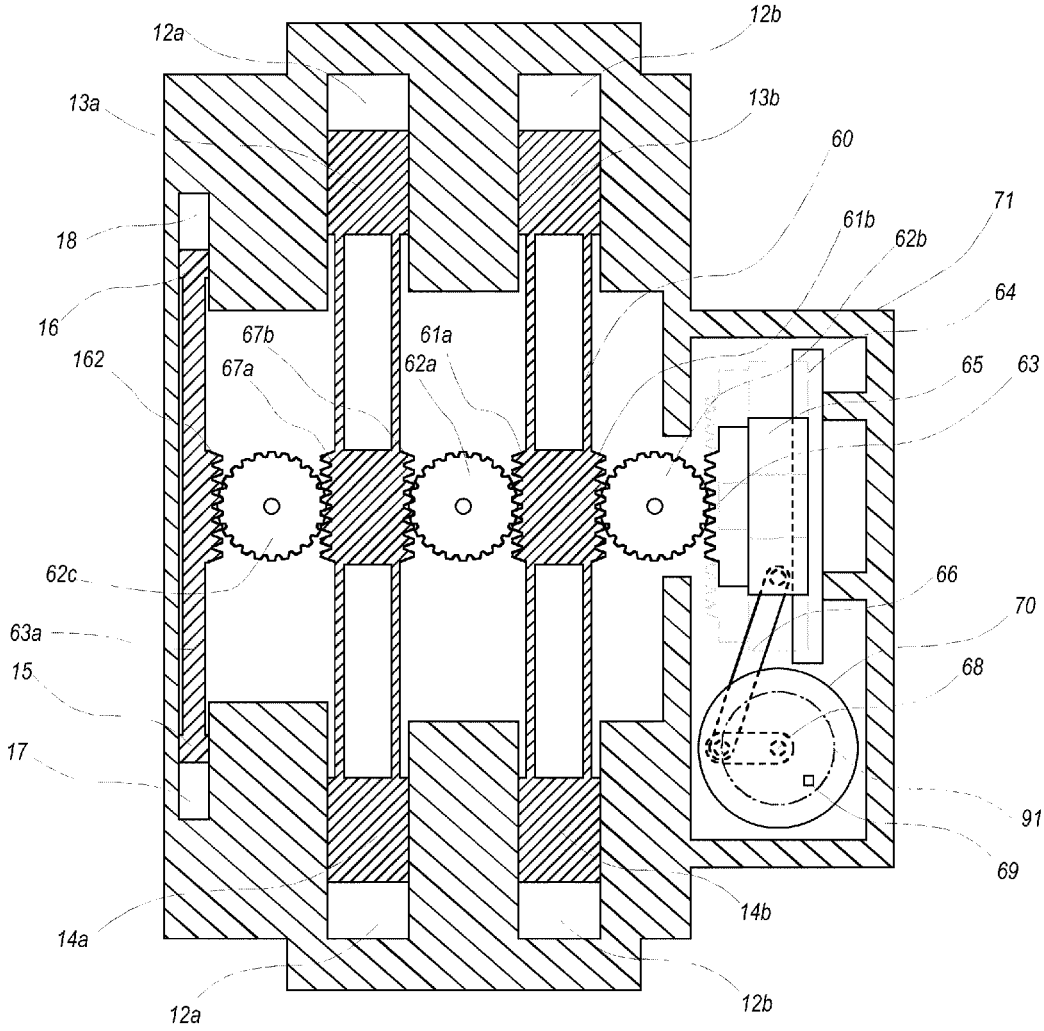
FIG. 12 presents a cross sectional view of an alternate embodiment of the engine of FIG. 7 in which the hydraulic pumping means is moved to a location away from the dual piston assemblies.

It should be noted that the quasi free piston engine of FIGS. 6-8 is not limited to use of an external cage for rigid connection of the combustion pistons. FIG. 12 depicts another embodiment in which the pumping cylinders are moved to a location analogous to that of the balancing member 63*a* of FIG. 6. Combustion pistons 13*a* and 14*a*, as well as 13*b* and 14*b*, are rigidly connected to reciprocate as single dual piston units and have teeth 61*a*, 61*b*, 67*a*, and 67*b* centrally located on opposite sides of respective rigidly connecting shafts. Balancing member 63*a* is configured with pumping pistons 15 and 16 relocated to respective ends thereof, with additional corresponding hydraulic lines serving respective pumping cylinders 17 and 18. Other ordinary means for connecting the opposing combustion pistons could also be used and need not be detailed here.

As will be understood, the inventions herein may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

I claim:

1. A quasi free piston internal combustion engine, comprising:

a pair of axially opposed combustion cylinders;

a pair of combustion pistons respectively mounted in said combustion cylinders for reciprocating linear motion therein, responsive to successive combustion events within said combustion cylinders;

a rigid means connecting said pair of combustion pistons to form a reciprocating dual piston assembly which reciprocates as a single unit;

pumping pistons driven by the linear motion of the combustion pistons;

a pair of axially aligned hydraulic cylinders respectively receiving said pumping pistons for reciprocating linear motion therein;

ports in each of said hydraulic cylinders for admitting fluid at a first pressure and discharging fluid at a second pressure higher than the first pressure;

a crankshaft mechanically connected to the dual piston assembly through a connecting rod; and a flywheel rotationally driven by the crankshaft.

2. The engine of claim 1, wherein the majority of power output of the engine is extracted through pressurizing the fluid from the first pressure to the second pressure and discharging a target volume of pressurized fluid.

3. The engine of claim 1, wherein the crankshaft limits travel of the combustion pistons within the combustion chambers such as to ensure top dead center positions for the combustion pistons within 1 millimeter of contacting an end (cylinder head) of the combustion cylinders without contacting said cylinder head.

4. The engine of claim 1, wherein the rotational momentum of the crankshaft and the flywheel together compel completion of travel of the combustion pistons to within 1 millimeter of contacting an end (cylinder head) of the combustion cylinders in the event that the force of a combustion event driving the dual piston assembly is insufficient on its own to compel travel of a combustion piston to within 1 millimeter of contacting the cylinder head.

5. The engine of claim 1, further comprising:

a sensor configured to send signals to an engine control unit allowing a determination of rotational velocity or acceleration of the crankshaft or flywheel;

wherein the engine control unit is programmed to adjust fuel feed to the engine responsive to said determination.

6. The engine of claim 1, further comprising:

a sensor configured to send signals to an engine control unit allowing a determination of rotational velocity or acceleration of the crankshaft or flywheel;

wherein the engine control unit is programmed to adjust a target hydraulic power extraction from the engine responsive to said determination.

7. The engine of claim 1, further comprising one or more additional dual piston assemblies and associated pumping pistons, hydraulic cylinders, and ports.

8. The engine of claim 1, further comprising a cam and camshaft rotationally driven through a mechanical connection with the crankshaft.

9. The engine of claim 8, further comprising:

a piston driven in a reciprocating linear direction within a fluid passage by intermittent engagement with the cam during rotation of the cam, wherein the fluid passage is hydromechanically connected to a first intake or exhaust valve of the engine such as to cause said first intake or exhaust valve to open or close upon engagement of the piston with the cam.

10. The engine of claim 9, further comprising a second piston likewise driven in a reciprocating linear direction, by intermittent engagement with the cam, within a second fluid passage, wherein the second fluid passage is hydromechanically connected to a second intake or exhaust valve of the engine, and wherein the cam rotation causes sequential opening and closing of the first and second valves at desired intervals for engine operation.

* * * * *